US005366223A

United States Patent [19]

Werner et al.

[11] Patent Number: 5,366,223

[45] Date of Patent: Nov. 22, 1994

[54] GOLF CLUB FACE FOR DRIVERS

[75] Inventors: Frank D. Werner, Box SR9, Jackson, Wyo. 83001; Richard C. Greig, Jackson, Wyo.

[73] Assignee: Frank D. Werner, Teton Village, Wyo.

[21] Appl. No.: 144,794

[22] Filed: Oct. 28, 1993

[51] Int. Cl.[5] ..... A63B 53/04

[52] U.S. Cl. ..... 273/175

[58] Field of Search ..... 273/167 R, 175

[56] References Cited

U.S. PATENT DOCUMENTS

| | | | |
|---|---|---|---|
| D. 241,956 | 10/1976 | Timbrook | D34/5 GH |
| D. 253,778 | 12/1979 | Madison | D21/214 |
| D. 313,828 | 1/1991 | Wilson | D21/214 |
| 1,211,708 | 1/1917 | Hudson | 273/175 |
| 1,299,014 | 4/1919 | O'Hara | 273/175 X |
| 1,901,562 | 3/1933 | Main . | |
| 2,023,885 | 10/1935 | Hinckley | 273/67 |
| 3,218,072 | 11/1965 | Burr | 273/78 |
| 3,305,235 | 2/1967 | Williams, Jr. | 273/81.2 |
| 3,625,518 | 12/1971 | Solheim | 273/175 |
| 4,280,700 | 7/1981 | Plagenhoef | 273/77 A |
| 4,444,392 | 4/1984 | Duclos | 273/77 A |
| 4,471,961 | 9/1984 | Masghati et al. | 273/175 |
| 4,618,149 | 10/1986 | Maxel | 273/79 |
| 4,840,380 | 6/1989 | Kajita et al. | 273/77 A |
| 4,874,171 | 10/1989 | Ezaki et al. | 273/77 A |
| 4,890,840 | 1/1990 | Kobayashi | 273/167 H |
| 4,995,609 | 2/1991 | Parente et al. | 273/80.2 |
| 5,060,951 | 10/1991 | Allen | 273/167 H |
| 5,094,457 | 3/1992 | Kinoshita | 273/167 |
| 5,098,103 | 3/1992 | MacKeil | 273/175 |
| 5,163,682 | 11/1992 | Schmidt et al. | 273/167 J |
| 5,172,913 | 12/1992 | Bouquet | 273/173 F |

FOREIGN PATENT DOCUMENTS 153475 10/1953 Australia .

*Primary Examiner*—William H. Grieb

*Attorney, Agent, or Firm*—Westman, Champlin & Kelly

[57] ABSTRACT

A golf club, specifically a driver, has a roughly elliptical face shape oriented so that the long axis of the ellipse is tilted upward at the toe at an angle of 20 degrees or more. This causes better agreement between the hit pattern and the perimeter of the club face, with the important result of minimizing the percentage of impacts which are not completely on the face of the club. This arrangement is for drivers since no other clubs are normally used with a tee and a consequence is that tilting the ball strike region of the face is not helpful for such clubs.

9 Claims, 4 Drawing Sheets

GOLF CLUB FACE FOR DRIVERS

BACKGROUND OF THE INVENTION

The present invention relates to the field of golf clubs and in particular, to the driver or number 1 wood used for tee shots.

A persistent problem, which is worse for golfers of high handicaps, is failure to hit the golf ball fully on the club strike face. The hits are sometimes partly off and even entirely off the face, with consequent extremely bad effects on the distance and accuracy of the hit. There are practical limits to enlarging the club strike face to reduce this problem. This fault of having the ball partially off the club face at impact is much less common with low handicap golfers, but it does happen now and then. For them, a small improvement is relatively as important as a large improvement is for a high handicap golfer.

A study was undertaken to determine if the typical shape of the face was reasonably suited to the typical pattern of hits on the face. The impact of a driver on a golf ball flattens the ball and leaves a circular contact area about 0.7 inch diameter or greater, with a standard golf ball. The center of this circular contact area will be referred to as the center of impact. An analysis was made of 11 hits by each of 28 golfers, with a driver, a 5-iron, and a 9-iron. The club strike face was covered with marking tape which marked the impact area and the locations of the centers of each of the impacts was measured and recorded. The study showed that there was a pronounced elliptical distribution pattern of impacts over that many swings, and we call this pattern the "hit pattern". Further, it was found that for drivers this elliptical pattern was rotated upward at the toe about 32 degrees.

The study showed that the driver faces were not oriented to take advantage of the shape of the hit patterns and the present invention relates to tilting the long axis of the outline of the face upward at the toe of a driver to cause a better match with the hit pattern. Enlarging the face is also helpful as stated, but when the face is enlarged and also tilted appropriately, the improvement is much enhanced.

In most prior art, commercially available driver face shapes have only a small amount of upward tilt and none appears to have nearly the tilt angle which minimized the percentage of hits which were off of the face (or partly off the face).

In U.S. Pat. No. 3,625,518 a driver is disclosed as having a curved bottom surface and in the disclosure an elliptical representation of the hit area is shown. The minor axis of the hit area is recited as being parallel to the club shaft axis and the patent disclosure calls for a bulge on the face to be formed about an axis parallel to the minor axis of the hit area to compensate for off center impact. The face surface is also rolled about an axis parallel to the long axis of the ellipse. Thus while the elliptical ball strike region is known in the prior art the solution for using this information to adapt the club head tilt to aid golfers was not recognized.

U.S. Pat. No. 4,471,961 illustrates an axis of rotation in FIG. 17 but does not indicate that orienting the club face to be tilted upward toward the toe will aid in insuring the ball will be hit on the club face. This patent is also concerned with the bulge and roll of the driver face.

A prior club that had a circular face is known to have been sold in about 1990. Since it was circular it had no long axis and the idea of rotation of its long axis has no meaning. Its shape is much different from the approximate ratio of length to width of 2, which is a ratio appropriate to match the hit pattern and is widely preferred.

SUMMARY OF THE INVENTION

This invention relates to orienting a golf driver head (the strike face area of a golf driver) at an appropriate angle relative the horizontal (tilt angle) to reduce the frequency of occurrence of hits which are partly or entirely outside the perimeter of the face of the driver. Such erroneous hits cause very large errors in direction and distance and the present invention significantly reduces this problem by providing a better alignment between the pattern of hits and the orientation of the face.

A study of the location of the centers of impacts of a golf ball (called a "hit pattern") on the face of a golf club indicates that the hits fall into an elliptical pattern. For a driver, such ellipses have a long axis which is rotated 32 degrees upward at the toe of the club. The range of tilt angles that is reasonably effective is 20 to about 36 degrees and the best results are in the ranges of 28 to 34 degrees. The optimum is at or near 32 degrees. Where the long axis of the face, as defined later, is tilted to approximately match the 32 degree rotation of the hit pattern ellipse, the frequency of hits off the face is much reduced. The long axis of the face of current designs of drivers usually is tilted upward somewhat at the toe but much less than the optimum.

The present invention goes beyond face enlargement because there is substantial alignment of the long axis of the face with the long axis of the known elliptical pattern of hits on the face.

DESCRIPTION OF THE PREFERRED EMBODIMENTS

Figure 1A:
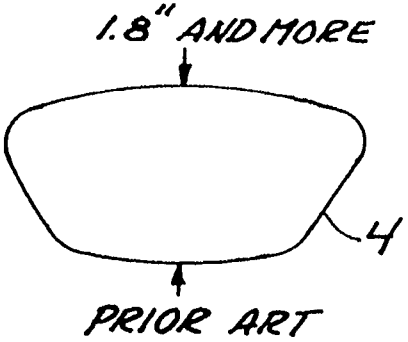
FIGS. 1A through 1C are front elevational views of typical golf drivers showings typical driver face heights.
Figure 1B:
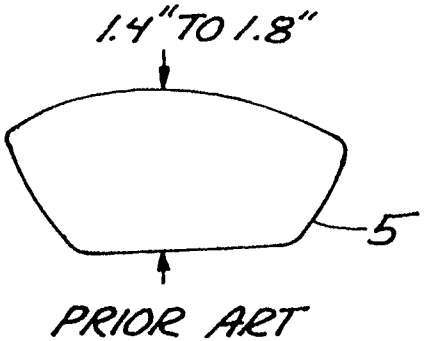
Figure 1C:
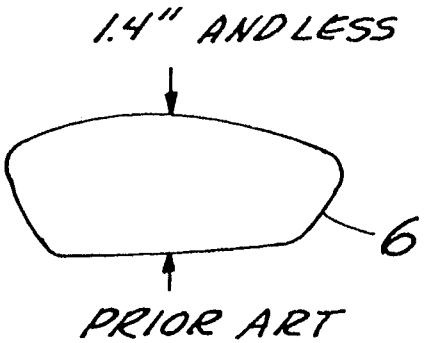

The present invention is best understood by a review of existing driver configurations as shown in FIGS. 1A, 1B, and 1C; 2A and 2B; and 3. A strike face shape which is elliptical is best, but the face shape is not of great importance so long as the face is roughly twice as long as it is wide. Non-elliptical face shapes are customary and customs are quite important in the game of golf, often for good reasons.

Figure 2A:
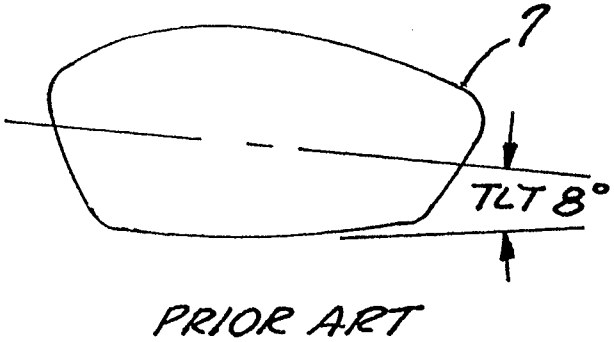
FIGS. 2A and 2B are front elevational views of prior art drivers which illustrate a popular traditional face shape and a more recent face shape, respectively.
Figure 2B:
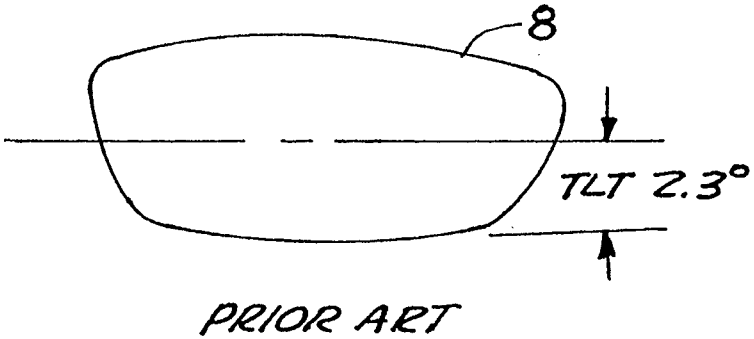

FIGS. 1A, 1B, 1C, 2A and 2B are very similar to FIGS. 41-1 and 41-2, page 387, in the book, "Golf Club Design, Fitting, Alteration, and Repair" by Ralph Maltby, copyright 1982. They show respectively, variations in driver face heights and in face shapes; for typical clubs. Numeral 4 in FIG. 1A represents a deep face, numeral 5 in FIG. 1B represents a conventional face depth, and numeral 6 in FIG. 1C represents a shallow face. FIGS. 2A and 2B illustrate a conventional driver face shape at 7 and a modern shape at 8.

Figure 3:
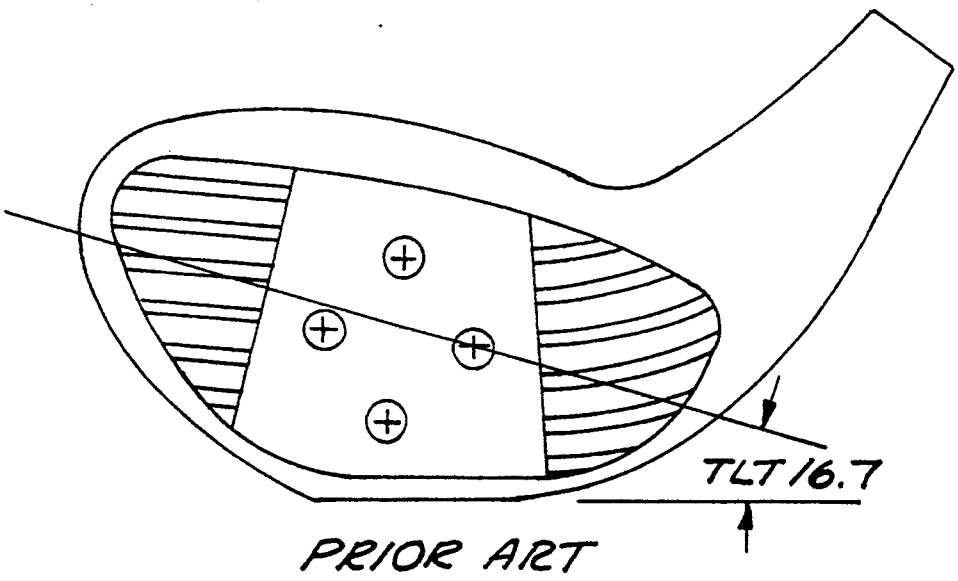
FIG. 3 is a front elevational view of a prior art driver which exhibits an upward tilt of the face at the toe showing an upward limit of tilt commercially available.

FIG. 3 is another representative driver face, pertinent in that it has the largest upward tilt at the toe of commercially available prior art drivers which the present inventors were able to locate for analysis.

For hits without a tee, it is not practical to have the impact point as high on the club face as may happen for drivers, because that would require that the sole of the club dig deeply into the turf, spoiling the hit. Thus the present invention is not concerned with irons or fairway woods or other clubs than the driver. Even if irons do have the long axis tilted considerably upward at the toe,as most do, normal use of such clubs does not involve impacts centered high on the face as can and does happen for drivers, and so their upward tilt at the toe is of no significance.

Figure 4:
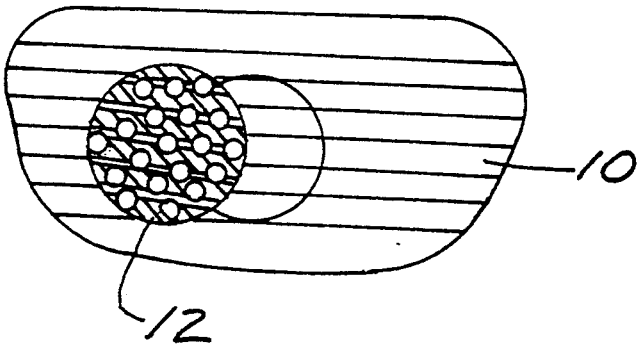
FIG. 4 is a front view of a typical driver face showing a typical impact pattern of a ball on the face of a driver.

FIG. 4 is a typical impact record, used for hit tests with 28 golfers. The marking tape which was applied to the driver face is represented at 10 and a typical ball impact mark is indicated at 12. The x and y position of the center of each ball impression was measured, x being the distance from the geometric center of the driver strike face toward the heel (negative if toward the toe), and y being the distance upward from the edge between the sole and the strike face of the club. For each golfer, the clubs used were the driver, the 5-iron, and the 9-iron for analysis. Only the data for the driver is of concern here. Various handicaps were represented for both men and women.

It was found that in both the x and y directions the distribution of the centers of the impacts was a "normal distribution" in statistical terms, or very nearly so.

Figure 5:
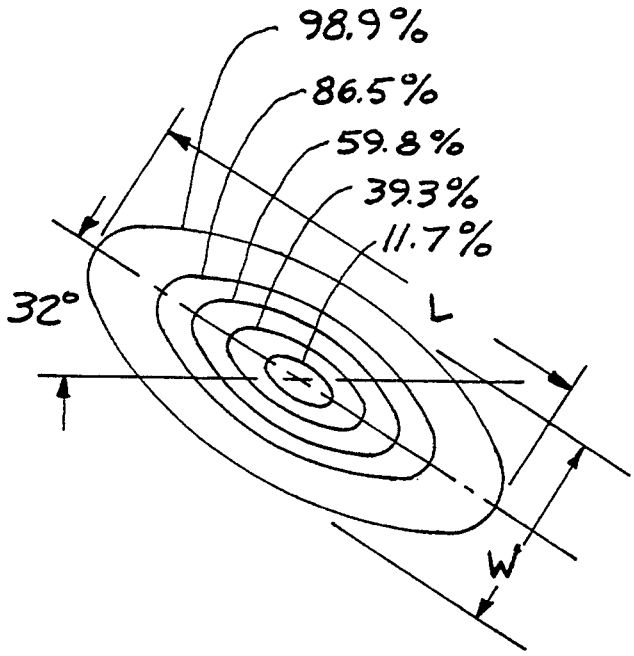
FIG. 5 is a graphical representation of the pattern or proportion of the scatter of impacts on the face of a driver for a particular individual golfer.

This characteristic allows the distributions to be described as a family of ellipses, such as shown in FIG. 5 for a 15 handicap golfer. Size and proportions of these ellipses and these angular orientations were varied by computer methods until we found the best match with the data. FIG. 5 uses a modification in which we have projected the hit pattern onto a vertical plane which is perpendicular to the sole line, which is approximately a vertical plane through the bottom of the face.

It was found that low handicap golfers had smaller ellipses and high handicap golfers had larger ellipses. The average for these golfers was an ellipse rotated at 32 degrees (toe high) for drivers.

FIG. 5 shows the actual hit pattern ellipses, near actual size, for the case of handicap 15. The overall length L of the ellipse is 2.81 inches and width W is 1.22 inches for the case of handicap 15 and for the size of ellipse which contains 98.9% of the center of the impacts (the outer ellipse in FIG. 5). The inner ellipses of FIG. 5 show the progressively smaller sizes which contain the various percentages of impacts within such ellipse as indicated in the figure. In statistical terms, these percentages represent 3, 2, 1.35, 1, and 0.5 standard deviations for the lengths of semi-major and semi-minor axes of the ellipses.

The correlation of ellipse size with handicap was fairly good as might be expected. This allowed making a mathematical description of the ellipse for a driver in the form of equations.

These equations are as given below using a nominal loft angle of 11 degrees for a driver, and using the following definitions: a is the standard deviation in the direction of the long axis of the ellipse, b is the standard deviation in the direction of the short axis, A is the area of this ellipse, R is a/b=2.314, HCP is the handicap, HPA (Hit Pattern Angle) is the angle by which the axis of the ellipse is rotated from horizontal such as to raise the toe end. SQR(n) means the square root of n and * means to multiply. Lengths are in inches and angles are in degrees.

(1) A=0.1094+.01263*HCP
(2) R=2.314
(3) HPA=32.0
(4) a=0.8582*SQR(A)
(5) b=0.3709*SQR(A)

Thus, when a is taken to be the semi-major axis and b is the semi-minor axis, these equations describe ellipses which contain one standard deviation of the scatter in each direction. Joint probability density analysis shows that for one standard deviation, 39.3% of all points are within the ellipse. Similarly, ellipses twice as long and twice as wide will contain 2 standard deviations in each direction, which is 86.5% of the points and ellipses having 3 times these dimensions will contain 98.9%.

Figure 6:
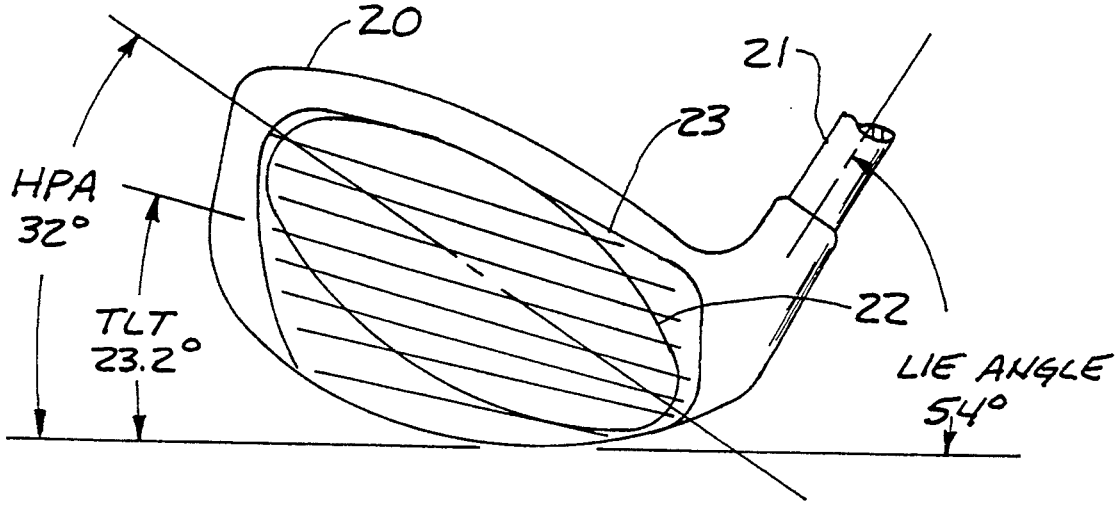
FIG. 6 is a front elevational view of a driver face oriented to embody the present invention,having effective upward tilt in direction of the toe.
Figure 7:
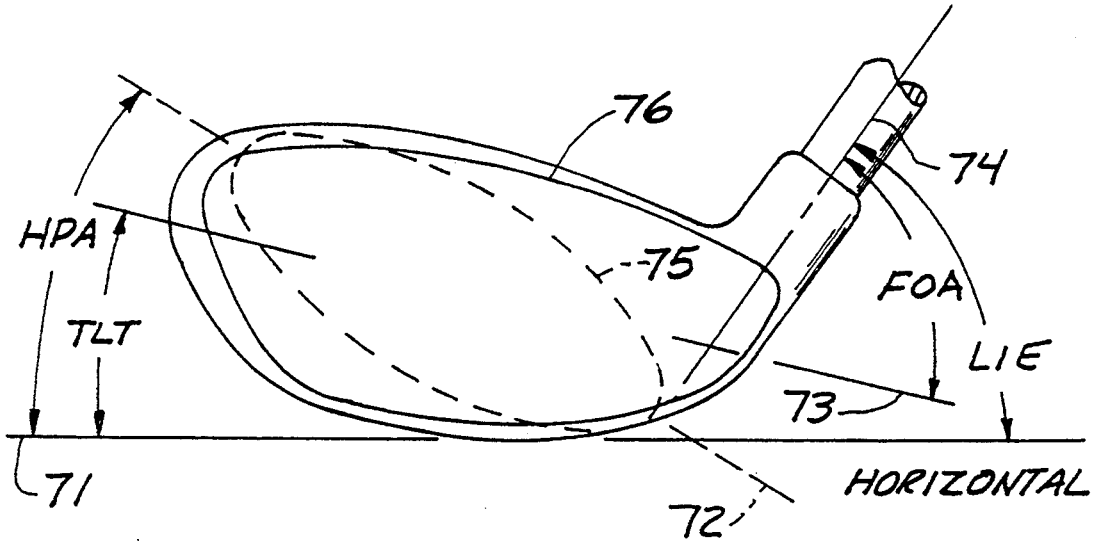
FIG. 7 is an illustrative representation which defines some of the angles referred to in the text.

Accordingly, for example, where an ellipse contains 98.9% of the center points of the hits, its semi-major axis is 3*a which gives 6*a for its major axis or "long axis" or "overall length". Similarly its width is 6*b. The area of an ellipse is pi*c*d where pi=3.1416, c is the semi-major axis and d is the semi-minor axis. Thus for the 98.9% ellipse, each of its axes are three times longer than the ellipse containing 39.3% (or one standard deviation) of points so its area is 3 squared or 9 times greater. This example is illustrated in FIGS. 6 and 7 and the 98.9% ellipse is in FIG. 5.

There was no marked difference between men and women when the results are expressed as shown by the equations above. The HPA was less for clubs shorter than the driver and the size of the pattern was smaller. As expected, smaller handicaps have smaller patterns.

For easy examination, these results (a and b in inches) for a driver are given in tabular form as follows:

TABLE 1

SIZE OF HIT PATTERN ELLIPSES

| handicap | area | a | b |
|---|---|---|---|
| 0 | .109 | .284 | .123 |
| 10 | .236 | .417 | .180 |
| 15 | .298 | .469 | .203 |
| 20 | .362 | .516 | .223 |
| 30 | .488 | .600 | .259 |

Off-center hits (which are still on the face) are detrimental because they alter the direction and distance of the hit as compared to center hits. This is well-known and widely studied. This type of error is different from the off-the-face errors with which this invention is concerned.

Especially for high handicap golfers, the hit is often so far from center that it is partly or even entirely off the hitting face of the club. This is a much smaller problem for fairly good golfers, but hits sometimes happen where the impact pattern is at least partly off the hitting face. Only the very best golfers almost always avoid this problem.

For these reasons, the size, shape, and orientation of the hitting face is very important. Good golfers are also concerned about these face design characteristics. The reason is that even though they generally make much smaller errors, a small error is relatively as important for good golfers as a very large error for a poor golfer.

The optimum face shape is therefore an ellipse with the same proportions as the hit pattern and oriented with its axis tilted upward at the toe end by 32 degrees, the same as for the hit pattern ellipses. Tilt angles of between 20 and 36 degrees are useful and a preferred range is between about 28 degrees and 34 degrees.

Furthermore, the face area should be as large as practical. Size is limited. If much larger than usual driver face size, the club head tends to weigh more than is acceptable and the result is that very large driver heads tend to be too fragile. Aerodynamic drag also increases for large faces, but experimental and theoretical studies show that this is generally a rather small influence.

FIG. 6 is representative of the face orientation of the present invention. The essential difference is that the long axis of the face is tilted up considerably more at the toe than the prior art. This is explained further below.

In FIG. 6, the ellipse size for a 15 handicap golfer which contains 98.9% of hits, was superimposed on the strike face image. This shows the benefits of tilting the long axis of the face outline to match the orientation of the ellipse. After this tilting, the face outline is a better match with the elliptical hit pattern.

In the above discussion, the "long axis" of a driver face is discussed, but for purposes of this specification it is defined in mathematical terms as the axis of the smaller of the two principal moments of inertia through the centroid of the surface representing the driver face. These terms also are further defined.

Again for purposes of this specification, the surface representing the driver face is defined as the projection of the actual curved driver face (which has bulge and roll) onto the plane surface which is tangent to the driver face at its center. This is much the same as the outline of the face as seen in the flat (plane) surface of a photo of the driver face. FIGS. 1–6 are representative of such projections.

A shape such as this has a "centroid", often called a center of gravity, which is the point at which a cardboard cut-out of the shape would balance on a pencil point.

Such a cut-out has a moment of inertia when rotated about any axis. In this analysis one is only concerned about axes through the centroid, and with two axes which are perpendicular to each other and which are both in the plane of the drawing figure. It is well known that there is one angular orientation of these axes at which there is a maximum moment of inertia about one axis and a minimum moment of inertia about the other. These are called the "principal axes". While illustrated and discussed in relation to a cardboard cut-out, actually the important meaning is for a plane area having no thickness and no weight. Mathematically, it is the integral of all incremental areas times the square of their perpendicular distances from the axis. A more correct but less used name is second moment, rather than moment of inertia.

For more detail on this subject, reference may be made to a text or handbook, such as pages 3–10 through 3–14 of "Standard Handbook for Mechanical Engineers", Baumeister and Marks, McGraw-Hill, copyright 1958.

FIG. 7 illustrates and precisely defines the angles discussed above. In FIG. 7, the solid line 71 is the horizontal. The dashed line 72 is the long axis of the hit pattern 75. The outline of the face is 76. The line 73 is the axis of the face which has minimum moment of inertia as explained and defined above. The shaft centerline is shown at 74.

HPA is the angular orientation of the long axis of the hit pattern ellipses. For drivers, HPA is 32 degrees. TLT is the angle by which the face axis 73 is rotated or "tilted".

At the golfer's address position, the shaft axis is at the LIE angle shown in FIG. 7. The LIE angle is generally considered to be 54 degrees for drivers, but there is no universal recognition of this number.

If a different value were chosen for LIE angle, the value for TLT would change. Therefore, we define FOA, the Face Orientation Angle, as shown in FIG. 7. FOA rather than TLT is thus the preferred description of the face orientation. This definition avoids any concern with the value for LIE angle, and as a result, there is no concern with angular orientations with respect to horizontal.

The orientation of the principal axis which represents the minimum moment of inertia of the driver face shapes of numerals 7 and 8 of FIGS. 2A and 2B and for FIG. 3 were measured. All were tilted upward somewhat at the toe. The tilt angle is labeled TLT in FIGS. 2A 2B and 3. The respective values for TLT were 8.0, 2.3, and 16.7 degrees.

For these 3 examples, it is of interest that the grooves in the face are generally not horizontal when the club is held at the normal position. For FIGS. 2A and 2B, horizontal was estimated as the tangent to the bottom edge of the face at the center of the face insert. For FIG. 3, the shaft was set at an angle of 54 degrees above horizontal, the design value. The respective groove angles were 3.1, 1.8, and 8.0 degrees, in all cases with the toe ends of the grooves high and heel ends low. It is important to note that TLT refers to the angle of the axis above the horizontal, not above the groove lines.

FIG. 6 shows a driver head 20 having a shaft 21, a face outline 23, and a superimposed ellipse 22 which is the outer 98.9% ellipse of FIG. 5. FIG. 6. incorporates an example of our improved TLT angle for the face outline 22, which is 23.2 degrees in this case. This design is a compromise between a larger TLT angle for even better performance and generally accepted appearance. A design for optimum performance would have used an elliptical face of the largest size consistent with adequate strength of the head, and the optimum value of 32 degrees TLT at the instant of impact. TLT angle at impact is about 1 to 4 degrees less than the value of TLT at address, because centrifugal force on the center of gravity of the head bends the shaft slightly downward during the swing, the amount depending on the square of the head speed and other factors.

A statistical analysis of the percentage of hits for which the impact pattern would be partly off the edge of the face was made for the design of FIG. 6. Consideration was made of the cases when the face long axis had values of TLT of 23.2, 13.2, and 3.2 degrees. The last, 3.2 degrees, is representative for conventional (prior art) TLT angle for this face shape. These results are given in Table 2. MPC approximately represents the minimum percentage of the impact area of the hit which is on the face. For example, MPC=80 means that a hit is counted as on the face if 80% or more of its impact area is within the boundary of the face.

TABLE 2

| | PERCENTAGE OF HITS OFF OF THE FACE | | | |
|---|---|---|---|---|
| Hcp | MPC | TLT = 3.2 | TLT = 13.2 | TLT = 23.2 |
| 0 | 100 | 7.4 | 5.1 | 0.1 |
| 0 | 80 | 0.1 | 0.0 | 0.0 |
| 0 | 50 | 0.0 | 0.0 | 0.0 |
| 10 | 100 | 30.1 | 26.4 | 19.4 |
| 10 | 80 | 5.6 | 2.8 | 0.0 |
| 10 | 50 | 0.4 | 0.0 | 0.0 |
| 20 | 100 | 50.9 | 43.6 | 42.9 |
| 20 | 80 | 16.4 | 7.4 | 0.0 |
| 20 | 50 | 4.6 | 0.5 | 0.0 |
| 30 | 100 | 55.6 | 51.4 | 46.3 |
| 30 | 80 | 26.1 | 18.2 | 11.7 |
| 30 | 50 | 7.4 | 4.4 | 2.8 |

Table 2 shows the marked advantage of a suitable TLT angle for higher handicap golfers. Also, as stated earlier, it is an important advantage, even though small, for good golfers.

In the research described above, what is fundamental is the relation between the face orientation and the shaft axis. In order to eliminate variables which are extraneous to the relation, the term "face orientation" angle is used in this description. FOA, as explained in connection with FIG. 7, is defined as the angle which lies in the plane of the shaft axis and the centroid of the face of the driver (a line and a point uniquely define a plane). Thus, FOA =TLT +LIE. The centroid has its exact mathematical meaning and its simplified name of center of gravity of the surface off the head, and the fact that the surface of the head is generally curved does not alter the meaning as compared to cases where the surface in question lies in a plane.

The analysis is done by projecting the outline of the face onto this plane. The principal moments of inertia of the closed curve thus obtained are determined. Finally, the FOA angle between the shaft and the axis of the lower of these two moments of inertia is found mathematically.

This definition is independent of the numerous other characteristics of a driver such as loft angle, lie angle, bulge, roll, etc.

Examination of cases shows that this process alters the shape and size of the face boundary only modestly.

Using this definition of face orientation, it was found that the face orientation angles of the prior art driver faces of FIG. 2A, numeral 7 to be 62.0 degrees, FIG. 2B, numeral 8 to be 56.3, and FIG. 3 to be 70.7 degrees. With this definition, the driver of FIG. 3 had the largest face orientation angle of any commercially available prior art which was found for analysis and the other two drivers are typical of prior art.

If a club face is elliptical and has a TLT angle of 32 degrees to match the HPA of 32 degrees, as shown in FIG. 5, and if the club has the usual LIE angle of 54 degrees, its face orientation angle, FOA, would be 86 degrees. Thus, the preferred range of values of FOA is between about 80 and 90 degrees. A face orientation angle of at least 74 degrees is preferred and it should not be more than about 90 degrees.

In Table 2, the tilt angles (TLT) of 3.2, 13.2 and 23.2 degrees correspond respectively to face orientation angles of 57.2, 67.2, and 77.2 degrees.

Although the present invention has been described with reference to preferred embodiments, workers skilled in the art will recognize that changes may be made in form and detail without departing from the spirit and scope of the invention.

What is claimed is:

1. A driver golf club head having an elongated face region having a face outline defined by an edge so oriented that the moment axis of the smaller of two principal moments of inertia of an area bounded by the edge of the face as projected onto a plane containing an axis of a shaft connected to the head and the centroid of the face region is oriented at least 74 degrees from the shaft axis in such direction as to cause a toe end of the face outline to become higher than a heel end with the club head in ball striking position and where increasing such angle causes the toe end to move higher.

2. The driver golf club head of claim 1 wherein the orientation of the moment axis is at least 80 degrees.

3. The driver golf club head of claim 1 wherein the orientation of the moment axis is in an preferred range of between 80 and 90 degrees.

4. The driver golf club head of claim 1 wherein the orientation of the moment axis is substantially 86 degrees.

5. The driver golf club head of claim 1 wherein the area formed by the edge and projected onto the plane is elliptical and has a length of between 1.5 and 3 times a width of the ellipse.

6. A driver golf club head having a heel and a toe and a striking face that has a major axis extending generally from heel to toe aligned with a selected moment axis of a selected moment of inertia of an area of the face passing through a centroid of the face and a minor axis perpendicular to the major axis, a shaft connected to the head, said shaft having an axis at a usual orientation of 54 degrees upward relative to a horizontal plane when the club head is in ball striking position, the head being coupled to the shaft such that the major axis is between 20 and 36 degrees above the horizontal plane with the head in a striking position.

7. The driver head of claim 6 wherein the major axis is substantially 32 degrees above horizontal.

8. The driver head of claim 6 having a striking face major axis and minor axis selected to be sufficient size for forming an ellipse on said face with the major axis and minor axis having an area substantially obtained by the equation A=9* (0.1094+0.01263*HCP) where A is the area, HCP is the handicap of the user of the driver head, and * means multiply.

9. The driver head of claim 8 wherein the major axis is equal to 6*a and the minor axis is equal to 6*b and substantially a=0.8582*SQR(A) and substantially b=0.3709*SQR(A), where SQR(A) is the square root of the area and * means multiply.

* * * * *

UNITED STATES PATENT AND TRADEMARK OFFICE

CERTIFICATE OF CORRECTION

PATENT NO. : 5,366,223

DATED : November 22, 1994

INVENTOR(S) : Frank D. Werner et al.

It is certified that error appears in the above-indentified patent and that said Letters Patent is hereby corrected as shown below:

Column 8, line 53, cancel "(0.1094+0.01263*HCP)"and insert --(.1094+.01263*HCP)--

Column 8, line 58, cancel "a=0.8582*SQR(A)" and insert --a=.8582*SQR(A)--

Column 8, line 59, cancel "b=0.3709*SQR(A)" and insert --b=.3709*SQR(A)--

Signed and Sealed this

Seventeenth Day of October, 1995

*Attest:*

Bruce Lehman

BRUCE LEHMAN

*Attesting Officer*

*Commissioner of Patents and Trademarks*